United States Patent [19]

Bussey

[11] Patent Number: 4,606,965

[45] Date of Patent: Aug. 19, 1986

[54] LOOSE FILL PACKING ELEMENT

[76] Inventor: Harry Bussey, P.O. Box 115, Serpentine Rd., Navesink, N.J.

[21] Appl. No.: 604,947

[22] Filed: Apr. 27, 1984

[51] Int. Cl.[4] ..... B32B 3/00; B32B 3/30

[52] U.S. Cl. ..... 428/158; 428/167; 428/174; 428/179; 428/156; 206/521; 206/584; 521/79

[58] Field of Search ..... 428/83, 167, 156–158, 428/174, 179; 206/DIG. 814, 521, 584; 521/79

[56] References Cited

U.S. PATENT DOCUMENTS

| | | | |
|---|---|---|---|
| 2,649,958 | 8/1953 | Rausch | 206/584 |
| 3,074,543 | 1/1963 | Stanley | 206/584 |
| 3,389,534 | 6/1968 | Pendleton | 206/584 X |
| 3,896,934 | 7/1975 | Graham et al. | 206/521 X |
| 4,027,064 | 5/1977 | Bussey, Jr. | 428/174 X |
| 4,166,875 | 9/1979 | Bussey, Jr. | 428/156 X |
| 4,169,179 | 9/1979 | Bussey, Jr. | 428/174 X |
| 4,215,166 | 7/1980 | Bussey, Jr. | 428/167 X |
| 4,269,895 | 5/1981 | Borchert et al. | 206/584 X |

*Primary Examiner*—George F. Lesmes
*Assistant Examiner*—Nancy A. B. Swisher
*Attorney, Agent, or Firm*—Kenyon & Kenyon

[57] ABSTRACT

The packing elements are made with flutes to reduce the amount of material and to provide for better heat transfer for expansion of the elements. The flutes are imparted during extrusion of the molten mass of thermoplastic material through a die opening by virtue of the opening having been formed with grooves.

12 Claims, 5 Drawing Figures

LOOSE FILL PACKING ELEMENT

This invention relates to a loose fill packing element. More particularly, this invention relates to a method of making fluted packing elements and to the elements made thereby.

As is known, various types of packaging materials have been known for use in insulating articles in shipping containers against damage from vibration and impact forces. In many cases, the packaging materials have been made up of loose fill packaging elements of resilient thermoplastic material, for example as described in U.S. Pat. Nos. 4,027,064 and 4,215,166. Generally, the loose fill packing elements have been formed as discrete elements with various shapes.

The intent of such loose fill packaging elements is to provide a cushion so that an item being transported in a carton can be protected against heavy or severe impacts or vibrations. However, in some cases, the elements may migrate within the carton due, in part, to the relatively smooth surfaces which are on the various packaging elements.

In order to insure against migration of a packaging item, shipping cartons are frequently provided with an excess of loose fill packaging elements to provide an increased insulation thickness between the item and the side walls of the carton.

Generally, when the loose fill packaging elements are made, a molten material is extruded through a die opening into a desired cross-sectional shape and subsequently cooled to a latent-foaming state and severed into individual elements. Thereafter, the latent-foaming or unexpanded elements are packaged into shipping containers to be shipped to an end user. The end user then heats the expandable elements to an expanded state and stores the elements in hoppers, or the like, for subsequent dispensing into individual cartons for packing purposes. In order to expand the elements to the desired size, it has frequently been necessary to pass a flow of the elements through a heating apparatus two or three times.

In the past, the latent-foaming elements have been extruded with smooth peripheral surfaces. When heated, the elements tend to expand uniformly by virtue of the heating of the exposed surfaces. Usually, the construction of the latent-foaming elements has been such that the elements begin to expand from the outside surfaces in toward the center. Thus, in many cases, the tough skin which usually forms the outer surfaces of an element splits open exposing the interior of the element prior to complete expansion. This differential heating of the elements can lead to exposure of the interior of the elements and the subsequent possibility of damage to the elements, for example breaking off of pieces of the elements.

Generally, the expanded packing elements are held in hoppers in a surface-to-surface condition. As a result, a static build-up between the elements frequently causes the elements to stick together with a result that they tend to clog or jam in an outlet of the hopper.

In those cases where the expanded elements are shipped in bulk to an end user, it has been customary for a bag of such elements to weigh approximately six pounds within a volume of about fourteen cubic feet. As such, the cost of shipping such expanded elements can be expensive due to the large volume occupied by the expanded elements.

Accordingly, it is an object of the invention to provide a loose fill packaging material which can be shipped in bulk at reduced cost.

It is another object of the invention to reduce the cost of shipping loose fill packaging materials in bulk.

It is another object of the invention to reduce the possibility of migration of loose fill packing elements in a shipping carton.

It is another object of the invention to reduce the need for substantial amounts of loose fill packing elements for cushioning purposes.

It is another object of the invention to reduce the heat energy required for expanding latent-foaming packing elements.

Briefly, the invention provides a loose fill packing element of resilient material which is of fluted construction. In particular, the element has a longitudinal axis, a longitudinal length less than a transverse width, a peripheral surface parallel to and about the longitudinal axis and a plurality of longitudinally extending grooves in the peripheral surface which are parallel to the longitudinal axis in order to define a plurality of flutes. The flutes and grooves are formed in the packing element so as to define a continuous peripheral surface having a tough skin.

The packing element may be of expandable nature or expanded nature. In the first case, the flutes which are formed in the expandable elements may have a radius of curvature of, for example 0.010 inches.

The invention also provides a method of making an expandable thermoplastic packing element which includes the steps of extruding a molten thermoplastic material containing a foaming agent through a die opening having a plurality of peripherally disposed longitudinally oriented grooves therein to form a plurality of grooves and alternating flutes in the extruded material. In addition, the extruded material is thereafter cooled to a latent-foaming state with the grooves and flutes defining a continuous peripheral surface having a tough skin.

The invention also provides a loose fill packaging material comprised of a plurality of expanded thermoplastic elements formed in the above manner.

The fluting on the packing elements is formed while the molten thermoplastic material is being extruded from the die. Thus, the fluting becomes an integral part of the element upon expansion of the element. In other words, there is no distortion or warping of the elements due to the fluting, for example as occurs in the case of the packing elements described in U.S. Pat. No. 4,215,166.

Since the peripheral surface of the elements remains intact, i.e. of continuous nature, the total surface area available for heating of the elements is increased. Further, the fluted arrangement permits heat to be more evenly imparted to the element with the result that there is an increased chance of heating the center of the element before the peripheral surface splits due to an excessive differential expansion. As a result, less heat is required in order to expand the elements to the desired expanded state. The fluted construction also permits the packing elements to be cooled in a more efficient manner due to the increased surface area. Further, the expanded element provides a relatively good insulator for packaging purposes.

The fluted construction provides less material for a given contour. Hence, when shipping the expanded elements in bulk, a standard bag of fourteen cubic feet in volume may weigh from 5½ to 5¾ pounds. This represents a savings of ½ to ¼ pound in shipping weight as well as a savings in raw material.

The fluted construction prevents slipping of the elements relative to each other in a packed carton since the flutes and grooves tend to grip as the tread of a rubber tire. This, in turn, reduces migration of the packaged item. Of note, while the fluted construction tends to reduce migration and slipping, the elements are still capable of flowing from a hopper under gravity.

The fluted construction also provides less area for static build-up since the recessed areas between the flutes cannot be rubbed by adjacent pieces or elements .

These and other objects and advantages of the invention will become more apparent from the following detailed description taken in conjunction with the accompanying drawings wherein.

Figure 1:
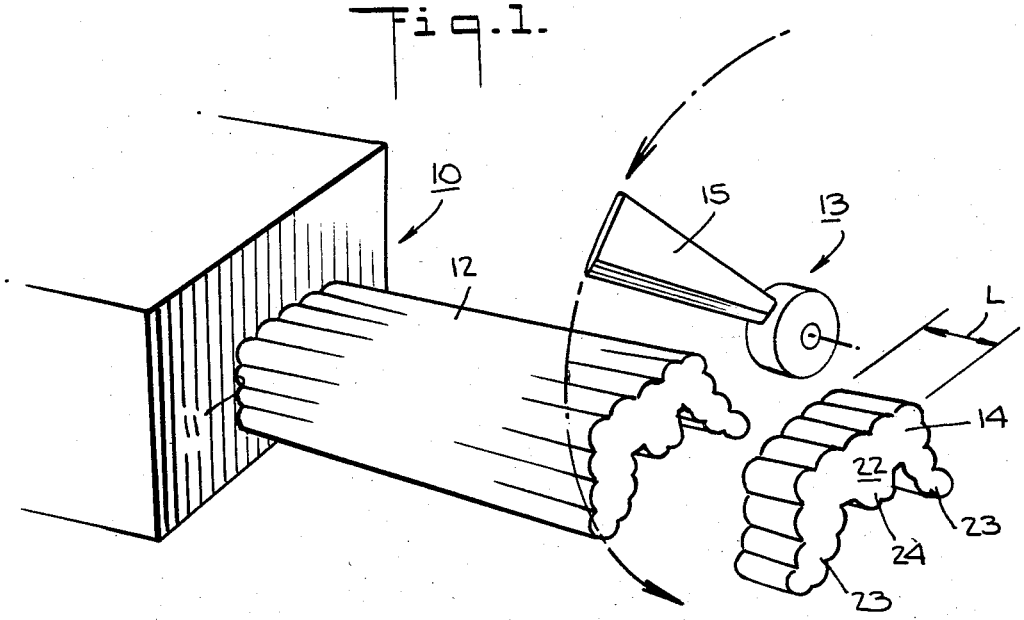
FIG. 1 illustrates a schematic view of an apparatus for making a fluted packing element in accordance with the invention.

Referring to FIG. 1, the apparatus for making an expandable thermoplastic packing element of fluted construction includes a die 10 having an opening 11 of predetermined shape through which a mass of molten thermoplastic material may be extruded as a shaped extrudate 12. In addition, the apparatus includes a means 13 for severing the extruded material into individual discrete elements 14. This means 13 may be in a form of a rotary blade 15 which is timed to cut through the extruded material 12 at given intervals to produce packing elements 14 of uniform longitudinal length L.

Figure 2:
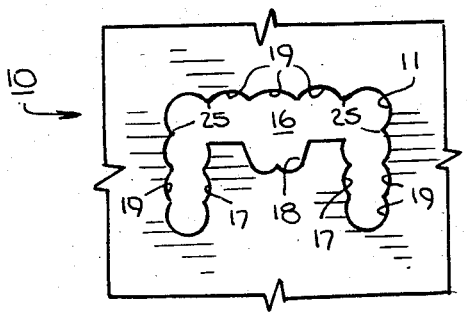
FIG. 2 illustrates an end view of the die of the apparatus of FIG. 1.

Referring to FIGS. 1 and 2, by way of example, the die opening 11 has a block-W shape, i.e. a shape having a main body portion 16, a pair of outwardly extending legs 17 and a centrally disposed leg 18 of shorter length than the outer legs. The die opening 11 is also provided with a plurality of peripherally disposed longitudinally oriented grooves 19 which are uniformly spaced the die opening.

In use, a mass of molten thermoplastic material containing a foaming agent is extruded through the die opening in conventional manner. During this time, the grooves 19 in the die opening form corresponding flutes 20 and alternating grooves 21 in the extruded material 13. Subsequently, the extruded material 13 which extends along a central longitudinal axis is severed by the rotary blade 15 into individual packing elements 14 of unexpanded or latent-foaming shape.

As indicated in FIG. 1, each expandable element 14 has a shape similar to the shape of the die opening 11 i.e. a block W shape with a rectangular main body portion 22, a pair of outwardly extending legs 23 and a central leg 24, except that the outer legs 23 tend to splay outwardly from each other a small amount while the central leg 24 tends to take on a trapezoidal shape.

The extruded material 13 may be cooled in known manner prior to severing into the individual elements 14 or may be cooled after the elements 14 have been severed. In any event, cooling takes place in a relatively short time so that the extruded material 13 is cooled to a latent-foaming state with the grooves 21 and flutes 20 defining a continuous peripheral surface having a tough skin.

Referring to FIG. 2, the grooves 19 which are formed in the die opening provide alternating ribs 25 which, in turn, form the grooves in the extruded material 13. By way of example, the main body portion 16 of the die opening has a transverse thickness of 0.050 inches. In this case, the grooves 19 in the die opening 11 are formed on a radius of curvature of 0.010 inches. The extruded latent-foaming element 14 which is formed from such a die opening 11 has corresponding dimensions.

Figure 3:
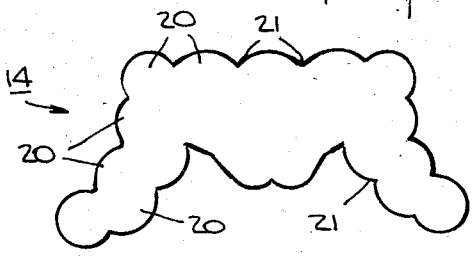
FIG. 3 illustrates an end view of a latent-foaming packing element according to the invention.

Referring to FIG. 3, the latent-foaming packing elements can be heated in bulk in order to achieve an expanded condition. For example, a mass of latent-foaming packing elements 14 may be passed through a heating aparatus (not shown) two or three times with expansion occurring during each pass. Since the grooves 21 and flutes 20 of each elements form a continuous skin, a relatively large surface area is presented for heat transfer into the body of the element 14. As a result, a better expansion of all the elements 14 takes place at a reduced heat energy requirement.

Referring to FIG. 3, after expanding, the expanded packing element 14 has a similar shape as the unexpanded packing element. This is because the flutes 20 and grooves 21 of the element expand in and at the same rate as the remainder of the element 14.

Figure 4:
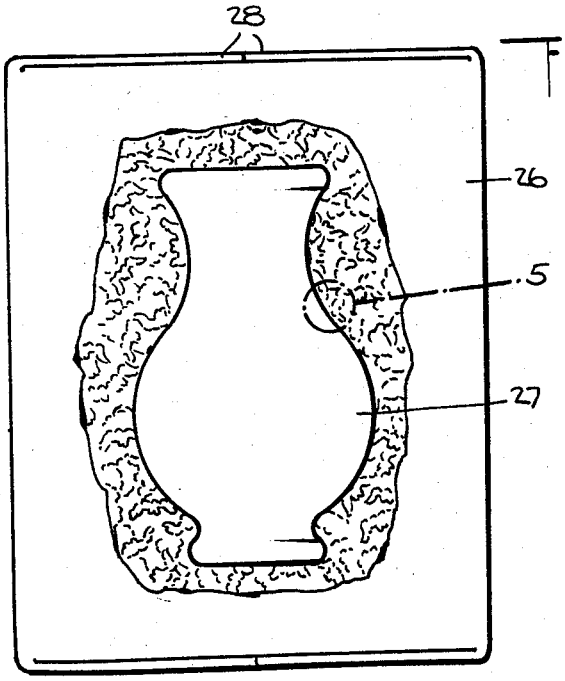
FIG. 4 illustrates a part cross-sectional view of a shipping carton having an item packaged therein by a packing material formed in accordance with the invention.
Figure 5:
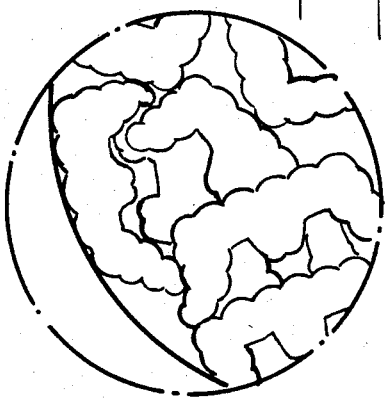
FIG. 5 illustrates a detail of the packaging material used in a shipping carton illustrated in FIG. 4.

Referring to FIGS. 4 and 5, the packaging elements 14 may be poured into a shipping container 26 to cushion an item 17 for shipping purposes. In this regard, a small quantity of the packaging material is first poured into the opened shipping carton 26 to form a base. Thereafter, the item 27 is seated on the base and then the remainder of the packaging material is poured about the item 27 usually to an over fill position. Next, the top flaps 28 of the container are folded over and pressed down to compress the overfilled material. This serves to gently squeeze the packing elements 14 together into a "locked" condition. As indicated in FIG. 5, the random placement of the elements 14 within the shipping container 26 is such that the flutes 20 and grooves 21 provide a roughened surface to further preclude relative shifting or migration of one element relative to another element. At the same time, the grooves 21 reduce the total amount of material used to make a given element and, thus, the amount of material required to package the item within the shipping container 26.

The invention thus provides a thermoplastic packaging material which can be made at reduced costs due to a reduction in the cooling energy and heating energy required to make the material.

The invention further provides a packaging material which is made up of fluted elements which enhance the ability of the elements to prevent migration of an item in a shipping container. Further, the fluted construction reduces the overall amount of material required to make a mass of packaging material.

What is claimed is:

1. A loose fill packing element of resilient thermoplastic material, said element having a central longitudinal axis with a longitudinal length less than a transverse width thereof, a peripheral surface parallel to and about said axis, and a plurality of longitudinally extending grooves in said surface parallel to said central axis to define a plurality of parallel flutes with said flutes and said grooves defining a continuous peripheral surface having a tough skin.

2. A loose fill packing element as set forth in claim 1, which is characterized in being expandable.

3. A loose fill packing element according to claim 2, wherein each flute has a radius of curvature of 0.010 inches.

4. A loose fill packing element according to claim 2 further having a rectangular body section and a pair of legs extending from said body section on one side thereof.

5. A loose fill packing element according to claim 4 further having a third leg extending from said body section to define a transverse cross section of block W shape.

6. A loose fill packing element according to claim 1, which is characterized in being expanded.

7. A loose fill packing element according to claim 6 further having a rectangular body section and a pair of legs extending from said body section on one side thereof.

8. A loose fill packing element according to claim 7, wherein said legs are directed laterally outwardly from each other.

9. A loose fill packing element according to claim 8 further having a third leg extending from said body section centrally of said pair of legs.

10. A loose fill packing element according to claim 1, wherein said grooves are equi-spaced about said peripheral surface.

11. A loose fill packing element according to claim 1 further having a body section with a transverse thickness of 0.050 inches and wherein each said flute has a radius of curvature of 0.010 inches.

12. A loose fill packaging material comprising a plurality of expanded thermoplastic elements, each said element having a central longitudinal axis with a longitudinal length less than a transverse width thereof, a peripheral surface parallel to and about said axis, and a plurality of longitudinally extending grooves in said surface parallel to said central axis to define a plurality of parallel flutes with said flutes and said grooves defining a continuous peripheral surface having a tough skin.

* * * * *

UNITED STATES PATENT AND TRADEMARK OFFICE

CERTIFICATE OF CORRECTION

PATENT NO. : 4,606,965

DATED : August 19, 1986

INVENTOR(S) : Harry Bussey

It is certified that error appears in the above-identified patent and that said Letters Patent is hereby corrected as shown below:

Column 1, line 24 "packaging" should be - packaged-
Column 1, line 26 "packaging" should be - packing-
Column 1, line 29 "packaging" should be - packing-
Column 3, line 48 "spaced the" should be -spaced around the-
Column 4, line 22 "elements" should be -element-

Signed and Sealed this

Twenty-fourth Day of March, 1987

*Attest:*

DONALD J. QUIGG

*Attesting Officer* *Commissioner of Patents and Trademarks*